US009235148B2

(12) United States Patent
Sugahara et al.

(10) Patent No.: US 9,235,148 B2
(45) Date of Patent: Jan. 12, 2016

(54) ELECTROSTATIC LATENT IMAGE DEVELOPING TONER

(71) Applicant: KYOCERA DOCUMENT SOLUTIONS INC., Osaka (JP)

(72) Inventors: Masanori Sugahara, Osaka (JP); Toshiki Takemori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 41 days.

(21) Appl. No.: 14/085,415

(22) Filed: Nov. 20, 2013

(65) Prior Publication Data

US 2014/0141368 A1 May 22, 2014

(30) Foreign Application Priority Data

Nov. 22, 2012 (JP) ..... 2012-256836

(51) Int. Cl.
*G03G 9/087* (2006.01)
*G03G 9/08* (2006.01)

(52) U.S. Cl.
CPC ..... *G03G 9/0821* (2013.01); *G03G 9/08782* (2013.01); *G03G 9/08795* (2013.01); *G03G 9/08797* (2013.01)

(58) Field of Classification Search
CPC ..... G03G 9/0821; G03G 9/08782; G03G 9/08795; G03G 9/08797
USPC ..... 430/108.4
See application file for complete search history.

(56) References Cited

U.S. PATENT DOCUMENTS

| | | | | |
|---|---|---|---|---|
| 5,635,325 | A | 6/1997 | Inaba et al. | |
| 7,056,638 | B1 | 6/2006 | Tomita et al. | |
| 2002/0172879 | A1 | 11/2002 | Kada et al. | |
| 2007/0111128 | A1* | 5/2007 | Patel et al. | 430/108.4 |
| 2010/0028795 | A1 | 2/2010 | Magome et al. | |
| 2013/0071783 | A1* | 3/2013 | Kuroyama | 430/108.4 |
| 2013/0164669 | A1* | 6/2013 | Yamashita et al. | 430/108.4 |

FOREIGN PATENT DOCUMENTS

| | | | |
|---|---|---|---|
| EP | 1223474 | A2 | 7/2002 |
| EP | 2287673 | A1 | 2/2011 |
| JP | H08-50368 | A | 2/1996 |
| JP | 2000-267338 | A | 9/2000 |

(Continued)

OTHER PUBLICATIONS

The extended European search report issued on Feb. 21, 2014, which corresponds to European Patent Application No. 13193799.7-1303 and is related to U.S. Appl. No. 14/085,415.

*Primary Examiner* — Christopher Rodee
(74) *Attorney, Agent, or Firm* — Studebaker & Brackett PC

(57) ABSTRACT

Electrostatic latent image developing toner includes at least a binder resin and a releasing agent. In the electrostatic latent image developing toner, a maximum thermal expansion coefficient difference ($Sw_{max}$–$Sr_{max}$), which is a difference between a maximum value ($Sw_{max}$) of a thermal expansion coefficient of the releasing agent and a maximum value ($Sr_{max}$) of a thermal expansion coefficient of the binder resin, is 1 or more, and a temperature at which the thermal expansion coefficient of the releasing agent reaches a maximum is 60° C. or more to 75° C. or less.

4 Claims, 3 Drawing Sheets

(56) References Cited

FOREIGN PATENT DOCUMENTS

| | | | |
|---|---|---|---|
| JP | 2002-006541 | A | 1/2002 |
| JP | 2007-114804 | A | 5/2007 |
| JP | 2011-138120 | A | 7/2011 |
| WO | WO 2012/029611 | A1 * | 3/2012 |

* cited by examiner

ELECTROSTATIC LATENT IMAGE DEVELOPING TONER

INCORPORATION BY REFERENCE

The present application claims priority under 35 U.S.C. §119 to Japanese Patent Application No. 2012-256836, filed Nov. 22, 2012. The contents of this application are incorporated herein by reference in their entirety.

BACKGROUND

The present application relates to electrostatic latent image developing toner.

Regarding toner used for electrophotography, a toner having excellent low temperature fixability is desired for achieving energy saving, compactness in device size, or the like. The toner having excellent low temperature fixability can be fixed by heating a fixing roller to a minimum. However, in many cases, the toner having excellent low temperature fixability includes a binder resin having a low melting point and a low glass transition point, and a releasing agent having a low melting point. Therefore, generally, the toner having excellent low temperature fixability has a problem of being likely to aggregate when stored at high temperature or to cause high temperature offset caused by the toner which sticks by melting to the heated fixing roller.

To solve the problem as described above, the toner with at least resin and wax is suggested. The resin included in this toner is a condensed resin. Then, the wax is included in each toner particle and is localized in the vicinity of a surface of the toner particles.

SUMMARY

Specifically, the present application provides the following.

An electrostatic latent image developing toner according to the present disclosure includes at least a binder resin and a releasing agent. A maximum thermal expansion coefficient difference ($Sw_{max}-Sr_{max}$) is 1 or more, the maximum thermal expansion coefficient being a difference between a maximum value ($Sw_{max}$) of a thermal expansion coefficient of the releasing agent and a maximum value ($Sr_{max}$) of a thermal expansion coefficient of the binder resin that are measured by the thermomechanical analysis (TMA). A temperature at which the thermal expansion coefficient of the releasing agent reaches a maximum is 60° C. or more and 75° C. or less.

DETAILED DESCRIPTION

Figure 1:
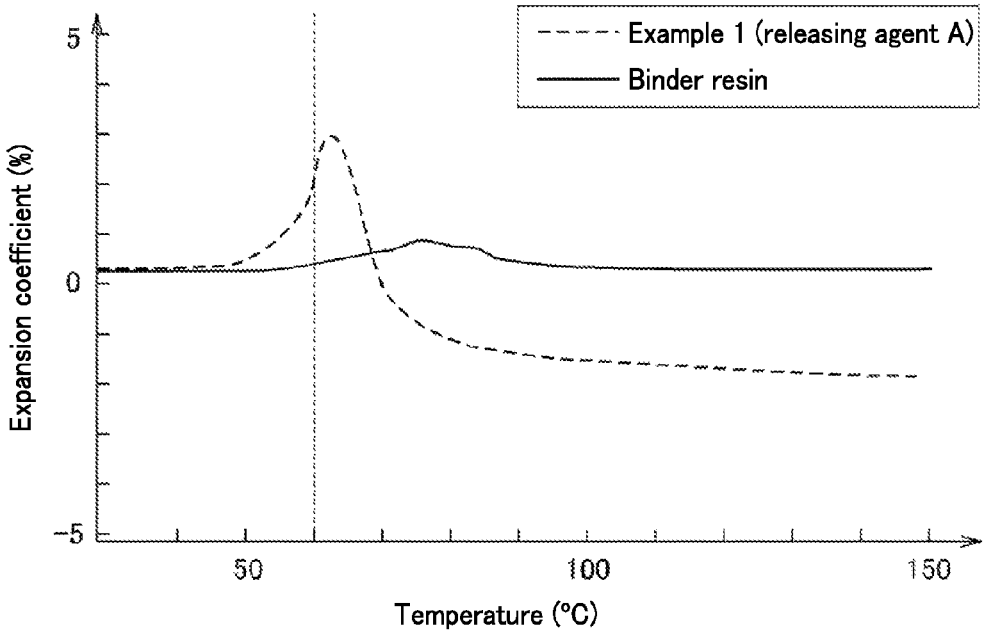
FIG. 1 is a diagram showing thermal expansion coefficient curves of a releasing agent and a binder resin that are included in toner in Example 1.
Figure 2:
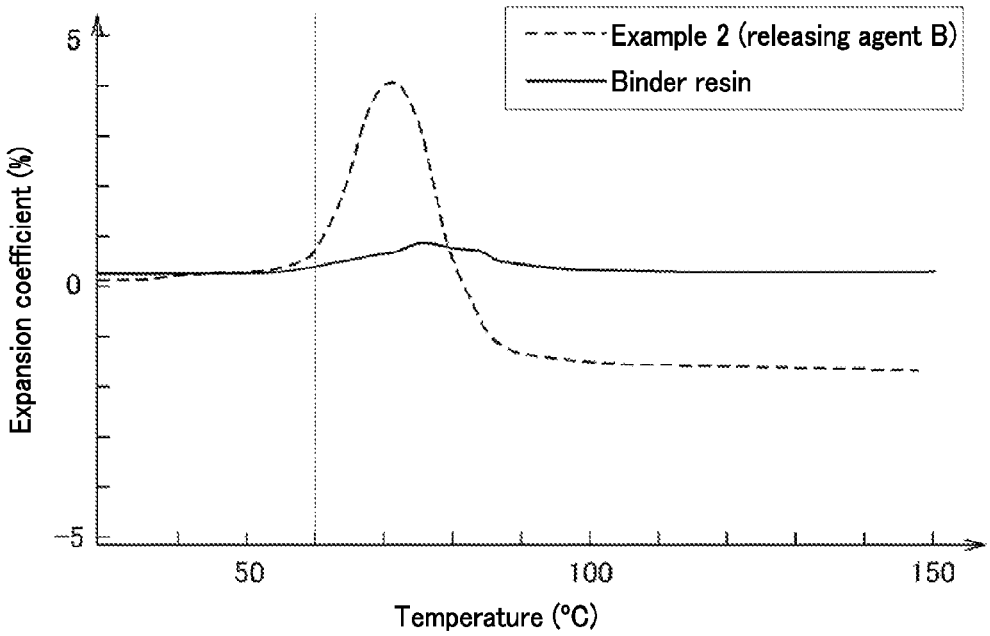
FIG. 2 is a diagram showing thermal expansion coefficient curves of a releasing agent and a binder resin that are included in toner in Example 2.
Figure 3:
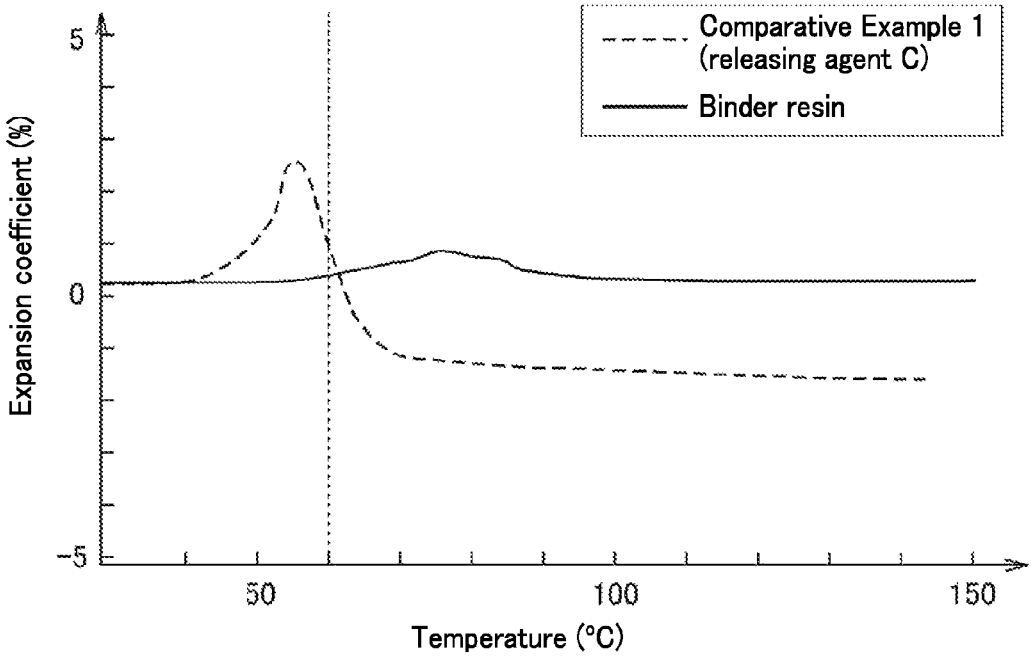
FIG. 3 is a diagram showing thermal expansion coefficient curves of a releasing agent and a binder resin that are included in toner in Comparative Example 1.
Figure 4:
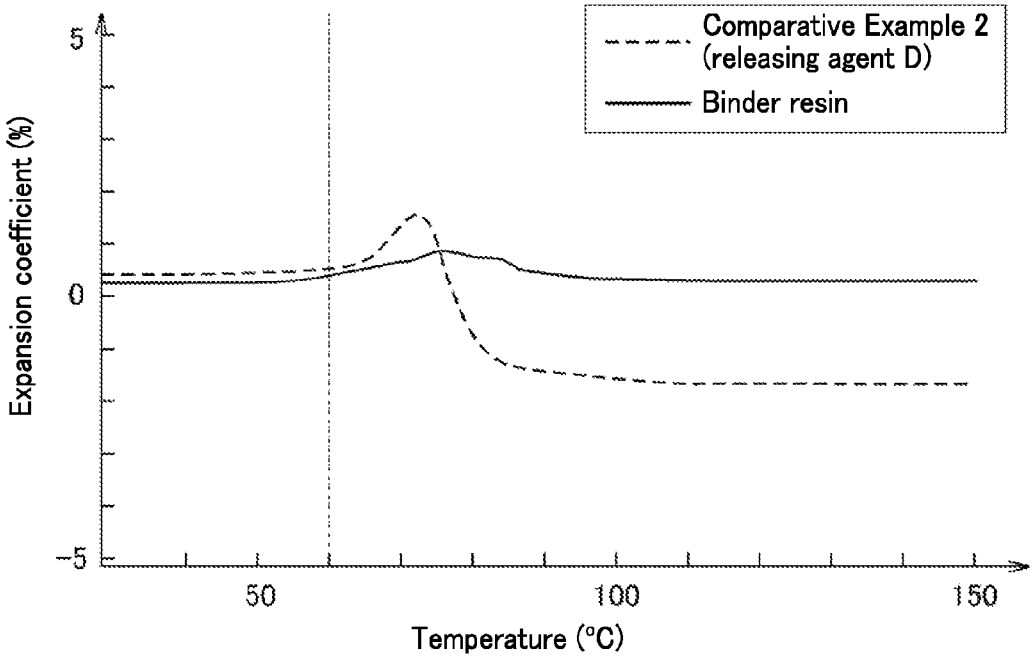
FIG. 4 is a diagram showing thermal expansion coefficient curves of a releasing agent and a binder resin that are included in toner in Comparative Example 2.
Figure 5:
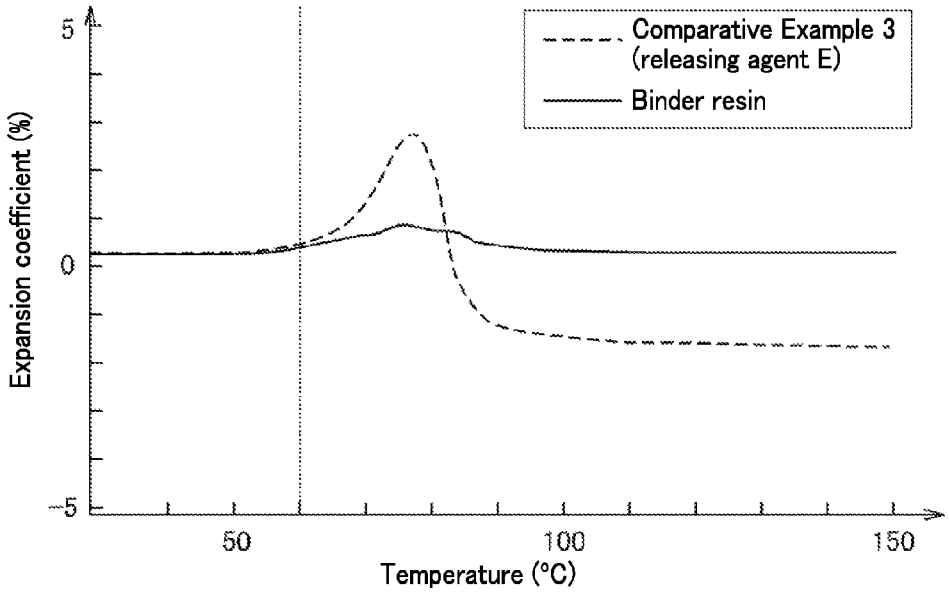
FIG. 5 is a diagram showing thermal expansion coefficient curves of a releasing agent and a binder resin that are included in toner in Comparative Example 3.
Figure 6:
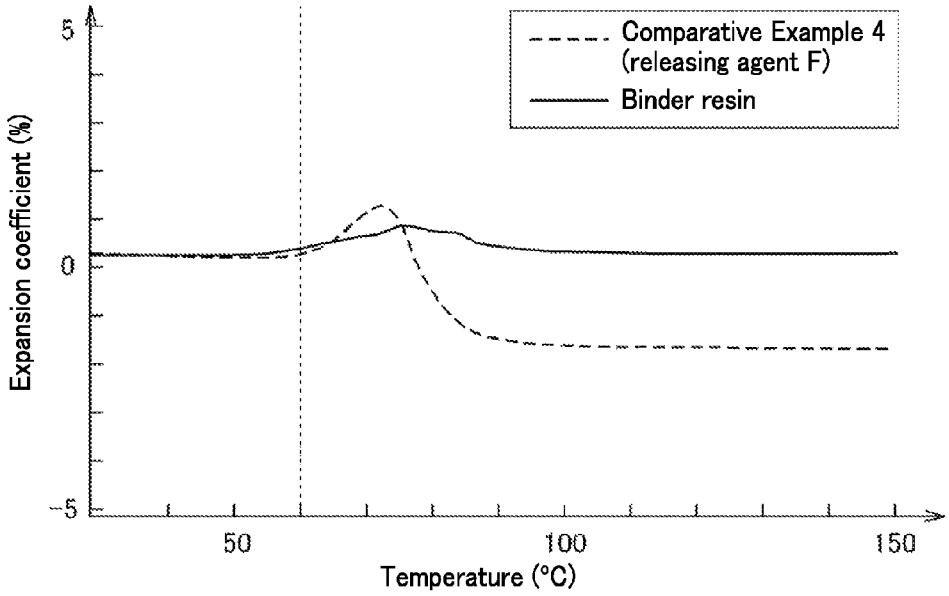
FIG. 6 is a diagram showing thermal expansion coefficient curves of a releasing agent and a binder resin that are included in toner in Comparative Example 4.

The following describes embodiments of the present disclosure in detail. The present disclosure is not limited to the embodiments below in any case, and is executable with modifications where appropriate within the scope of the present disclosure. It should be noted that for the point where descriptions are overlapped, the description may be omitted where appropriate, which, however, is not to limit the content of the present disclosure.

The electrostatic latent image developing toner according to the present disclosure (hereinafter, also referred to as the toner) includes at least a binder resin and a releasing agent. In addition, a maximum value of a thermal expansion coefficient of the releasing agent and a maximum value of a thermal expansion coefficient of the binder resin, which are measured using thermomechanical analysis, have a predetermined relationship. Then, a temperature at which the thermal expansion coefficient of the releasing agent reaches a maximum is within a predetermined range.

The toner according to the present disclosure may include an optional component such as a colorant, a charge control agent, and magnetic powder other than the binder resin and the releasing agent. In addition, in the toner according to the present disclosure, an external additive may be added to a surface of each toner base particle as necessary. In addition, the toner according to the present disclosure may also be mixed with a desired carrier and used as a two component developer. Hereinafter, regarding the toner according to the present disclosure, the following describes: essential components (binder resin and releasing agent) and optional components (colorant, charge control agent, magnetic powder, and external additive). Furthermore, the following describes, in order, a method of manufacturing the toner according to the present disclosure, a carrier that is used in the case of using the toner according to the present disclosure as a two component developer, and the thermomechanical analysis (TMA).

[Binder Resin]

Binder resin included in the toner is selected such that the maximum value of the thermal expansion coefficient of the releasing agent and the maximum value of the thermal expansion coefficient of the binder resin have a predetermined relationship. It should be noted that the maximum value of the thermal expansion coefficient is measured by thermomechanical analysis (TMA) that is to be described later. A specific example of the binder resin is a thermoplastic resin such as: styrene-based resin, acrylic resin, styrene-acrylic resin, polyethylene-based resin, polypropylene-based resin, vinyl chloride-based resin, polyester resin, polyamide resin, polyurethane resin, polyvinyl alcohol-based resin, vinyl ether-based resin, N-vinyl-based resin, or styrene-butadiene based resin. Among these resins, due to excellence in colorant dispersibility in the toner, toner chargeability, and toner fixability onto paper, the styrene-acrylic resin or the polyester resin is preferable. The following describes the styrene-acrylic resin and the polyester resin.

The styrene-acrylic resin is a copolymer of a styrene-based monomer and an acrylic monomer. For specific examples of the styrene-based monomer, it is possible to give a monomer such as: styrene, α-methylstyrene, vinyltoluene, α-chlorostyrene, o-chlorostyrene, m-chlorostyrene, p-chlorostyrene, or p-ethylstyrene. For specific examples of the acrylic monomer, it is possible to give a monomer such as: (meth)acrylate alkyl ester such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, or iso-butyl methacrylate.

For the polyester resin, it is possible to use resin obtained by condensation polymerization of an alcohol component that is divalent or of a valence of 3 or more, and a carboxylic acid component that is divalent or of a valence of 3 or more, or by copolycondensation of these. For a component used for synthesizing the polyester resin, an alcohol component that is divalent or of a valence of 3 or more, or a carboxylic acid component that is divalent or of a valence of 3 or more can be used as below.

For specific examples of the alcohol component that is divalent or of a valence of 3 or more, it is possible to give: diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, or polytetramethylene glycol; bisphenols such as bisphenol A, hydrogenated bisphenol A, polyoxyethylene-modified bisphenol A, or polyoxypropylene-modified bisphenol A; or alcohols having a valence of 3 or more such as sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, or 1,3,5-trihydroxymethylbenzene.

For specific examples of the carboxylic acid that is divalent or of a valence of 3 or more, it is possible to give: divalent carboxylic acid such as maleic acid, fumaric acid, citraconic acid, itaconic acid, glutaconic acid, phthalic acid, isophthalic acid, terephthalic acid, cyclohexanedicarboxylic acid, succinic acid, alkylsuccinic acid or alkenylsuccinic acid with n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, or isododecenylsuccinic acid, adipic acid, sebacic acid, azelaic acid, and malonic acid; and carboxylic acid having a valence of 3 or more such as 1,2,4-benzene tricarboxylic acid (trimellitic acid), 1,2,5-benzene tricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, or EMPOL trimer acid. These carboxylic acid components that are divalent or of a valence of 3 or more may be formed as an ester-forming derivative such as acid halide, anhydride, or lower alkyl ester for use. Here, the "lower alkyl" refers to an alkyl group having the number of carbon atoms from 1 to 6.

In the case of using the polyester resin for the binder resin, a softening point of the polyester resin should preferably be 80° C. or more and 150° C. or less, and more preferably be 90° C. or more and 140° C. or less.

For the binder resin, for sufficient fixability, it is preferable to use a thermoplastic resin. However, not only can the thermoplastic resin be used by itself, but a crosslinking agent or a thermosetting resin can also be added to the thermoplastic resin. By partially introducing a crosslinking structure into the binder resin, it is possible to increase preservation stability, shape retention characteristic, and durability of the toner without reducing the toner fixability.

For the thermosetting resin that can be used with the thermoplastic resin, an epoxy resin or a cyanate-based resin is preferable. Specific example of a preferred thermosetting resin includes a thermosetting resin such as: bisphenol A type epoxy resin, hydrogenated bisphenol A type epoxy resin, novolac-type epoxy resin, poly(alkylene ether)-type epoxy resin, cyclic aliphatic-type epoxy resin, or cyanate resin. Two or more types of these thermosetting resins can be used in combination with each other.

The glass transition point (Tg) of the binder resin should preferably be 50° C. or more and 65° C. or less, and more preferably be 50° C. or more and 60° C. or less. If the glass transition point (Tg) of the binder resin is too low, there is a case where the toner melts and clings together in a development section of an image forming apparatus, or part of the toner melts and clings together during the transportation of the toner container or during storage in the warehouse. On the other hand, if the glass transition point (Tg) of the binder resin is too high, the strength of the binder resin decreases, and it becomes more likely to increase toner attachment to a latent image bearing member. In addition, if the glass transition point (Tg) of the binder resin is too high, there is a tendency that the toner is not sufficiently fixed at low temperature.

It should be noted that the glass transition point (Tg) of the binder resin can be obtained from a change point of specific heat of the binder resin, using a differential scanning calorimeter (DSC). More specifically, it is possible to obtain the glass transition point (Tg) of the binder resin by measuring an endothermic curve of the binder resin, using, for example, DSC-6200 manufactured by Seiko Instruments Inc as a measurement device. By placing 10 mg of the binder resin in an aluminum pan as a measurement sample and using an empty aluminum pan as a reference, measurement is performed under conditions that: a measurement temperature range is 25° C. or more and 200° C. or less and a temperature increase rate is 10° C./min under normal temperature and normal humidity, so as to obtain the endothermic curve. Using the endothermic curve of the binder resin that is obtained, it is possible to obtain the glass transition point (Tg) of the binder resin.

It is preferable that the number average molecular weight (Mn) of the binder resin be 3000 or more and 6000 or less. In addition, it is preferable that the mass average molecular weight (Mw) of the binder resin be 200000 or more and 500000 or less. By setting the number average molecular weight (Mn) and the mass average molecular weight (Mw) of the binder resin within such a range, it is possible to obtain the toner that allows realizing sufficient fixability within a wider range of temperature. In addition, it is preferable that a molecular weight distribution (Mw/Mn), which is represented by a ratio between the number average molecular weight (Mn) and the mass average molecular weight (Mw), be 67 or more and 83 or less. By setting the molecular weight distribution of the binder resin within such a range, it is possible to obtain the toner that allows realizing sufficient fixability within a wider range of temperature. The number average molecular weight (Mn) and the mass average molecular weight (Mw) of the binder resin can be measured using, for example, a gel permeation chromatography.

[Releasing Agent]

The electrostatic latent image developing toner according to the present disclosure includes a releasing agent for improvements in fixability and offset resistance. The releasing agent is selected such that the maximum value of thermal expansion coefficient of the releasing agent and the maximum value of thermal expansion coefficient of the binder resin have a predetermined relationship and that the temperature at which the thermal expansion coefficient of the releasing agent reaches the maximum is within a predetermined range. It should be noted that the maximum value of the thermal expansion coefficient of the releasing agent is measured using thermomechanical analysis (TMA) to be described later.

For the releasing agent, wax is preferable, and examples of the wax include: ester wax, polyethylene wax, polypropylene wax, fluororesin wax, Fischer-Tropsch wax, paraffin wax, or montan wax. For the ester wax, synthetic ester wax, or natural ester wax such as carnauba wax or rice wax can be given. Two or more types of these releasing agents can be used in combination with each other. Among these releasing agents, ester wax is more preferable.

Among the ester waxes, synthetic ester wax is preferable for reasons that appropriate selection of a synthetic material facilitates adjusting the maximum value of the thermal expansion coefficient of the releasing agent and the temperature at which the thermal expansion coefficient of the releasing agent reaches the maximum, and that such synthetic material is less likely to be affected by impurity.

A method for manufacturing the synthetic ester wax is not particularly limited as long as a chemical synthesis method is used. For example, the synthetic ester wax can be synthesized using a publicly known method such as a reaction between alcohol and carboxylic acid in the presence of an acid catalyst or a reaction between carboxylic acid halide and alcohol. It should be noted that the material for the synthetic ester wax may be derived from a natural material, for example, long-chain fatty acid manufactured from natural fat. In addition, for the synthetic ester wax, a commercially-available synthetic may be used.

For the releasing agent used for the toner according to the present disclosure, the thermal expansion coefficient of the releasing agent reaches the maximum at a temperature of 60° C. or more and 75° C. or less. By setting the temperature at which the thermal expansion coefficient of the releasing agent reaches the maximum within such a range, it becomes easier to obtain the toner having excellent high temperature offset resistance and excellent heat-resisting preservation stability.

If the temperature at which the thermal expansion coefficient of the releasing agent reaches the maximum is too low, an expansion of the releasing agent occurs in a low temperature range. Therefore, the toner, which includes the releasing agent of which the thermal expansion coefficient reaches the maximum at a temperature below 60° C., shows sufficient mold releasability in the low temperature range. However, such toner has poor releasability in a high temperature range. Thus, in the case of forming an image using the toner with a releasing agent of which the thermal expansion coefficient reaches the maximum at a temperature below 60° C., offset is more likely to occur at high temperature. In addition, when stored at high temperature, the toner, which includes the releasing agent of which the thermal expansion coefficient reaches the maximum at a temperature below 60° C., has poor preservation stability because the releasing agent is likely to exude from the toner.

On the other hand, if the temperature at which the thermal expansion coefficient of the releasing agent reaches the maximum is too high, the expansion of the releasing agent occurs in the high temperature range. Therefore, the toner, which includes a releasing agent of which the thermal expansion coefficient reaches the maximum at a temperature over 75° C., shows sufficient mold releasability in the high temperature range. However, such toner has difficulty in performing sufficient mold releasability within the low temperature range, and therefore has poor low temperature fixability.

The average carbon number of the releasing agent should preferably be 38 or more and 42 or less, and more preferably be 39 or more and 41 or less. By setting the average carbon number of the releasing agent within such a range, it becomes easier to obtain the toner having excellent high temperature offset resistance and heat-resisting preservation stability. In addition, by setting the average carbon number of the releasing agent within such a range, it becomes easier to adjust the temperature at which the thermal expansion coefficient of the releasing agent reaches the maximum, which is measured using thermomechanical analysis (TMA), to 60° C. or more and 75° C. or less. For example, it is possible to decrease the temperature at which the thermal expansion coefficient of the releasing agent reaches the maximum by reducing the average carbon number of the releasing agent. In addition, it is possible to increase the temperature at which the thermal expansion coefficient of the releasing agent reaches the maximum by increasing the average carbon number of the releasing agent.

The amount of use of the releasing agent should preferably be 1 part by mass or more and 5 parts by mass or less, with respect to 100 parts by mass of the binder resin. If the amount of use of the releasing agent is too small, there is a case where a desired effect cannot be produced in suppressing occurrence of offset or image smearing. On the other hand, if the amount of use of the releasing agent is too large, there is a case where the preservation stability of the toner decreases due to the toner melted and clinging together.

[Colorant]

The electrostatic latent image developing toner according to the present disclosure may include a colorant in the binder resin. The colorant included in the toner is appropriately selected from among publicly known pigments or dyes according to the color of toner particles. For specific examples of the preferred colorant to be added to the toner, it is possible to give: a black pigment such as carbon black, acetylene black, lampblack, or aniline black; a yellow pigment such as chrome yellow, zinc yellow, cadmium yellow, yellow iron oxides, mineral fast yellow, nickel titanium yellow, Naples yellow, naphthol yellow S, hansa yellow G, hansa yellow 10G, benzidine yellow G, benzidine yellow GR, quinoline yellow lake, permanent yellow NCG, or tartrazine lake; an orange pigment such as orange chrome, molybdenum orange, permanent orange GTR, pyrazolone orange, vulcan orange, or indanthrene brilliant orange GK; a red pigment such as red iron oxide, cadmium red, red lead, cadmium mercury sulfide, permanent red 4R, lithol red, pyrazolone red, watching red calcium salt, lake red D, brilliant carmin 6B, eosin lake, rhodamine lake B, alizarin lake, or brilliant carmin 3B; a purple pigment such as manganese violet, fast violet B, or methyl violet lake; a blue pigment such as Prussian blue, cobalt blue, alkali blue lake, Victoria blue partial chlorinated product, fast sky blue, or indanthrene blue BC; a green pigment such as chrome green, chromium oxide, pigment green B, malachite green lake, or final yellow green G; a white pigment such as zinc oxide, titanium oxide, antimony white, or zinc sulfide; and an extender pigment such as baryta powder, barium carbonate, clay, silica, white carbon, talc, or alumina white. Two or more types of these colorants can be used in combination with each other for the purpose of adjusting a hue of the toner to a desired hue.

The amount of use of the colorant should preferably be 1 part by mass or more and 10 parts by mass or less, with respect to 100 parts by mass of the binder resin, and more preferably be 3 parts by mass or more and 8 parts by mass or less.

[Charge Control Agent]

The electrostatic latent image developing toner according to the present disclosure may include a charge control agent as necessary. The charge control agent is used for obtaining the toner having excellent durability and stability through improvements in a charge level stability and a charge rise characteristic of the toner, which indicates whether or not charging the toner up to a predetermined charge level is possible within the short time. In the case of positively charging the toner for performing development, a positively chargeable charge control agent is used. On the other hand, in the case of negatively charging the toner for performing development, a negatively chargeable charge control agent is used.

The type of the charge control agent can be appropriately selected from among charge control agents used for toner since before. For specific examples of the positively chargeable charge control agent, it is possible to give: an azine compound such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, or quinoxaline; direct dyes made of an azine compound such as azine fast red FC, azine fast red 12BK, azine violet BO, azine brown 3G, azine light brown GR, azine dark green BH/C, azine deep black EW, or azine deep black 3RL; a nigrosine compound such as nigrosine, nigrosine salt, or a nigrosine derivative; an acid dye made of a nigrosine compound such as nigrosine BK, nigrosine NB, or nigrosine Z; metal salts of naphthenic acid or higher fatty acid; alkoxylated amine; alkylamide; and quarternary ammonium salt such as benzylmethylhexyldecylammonium or decyltrimethylammonium chloride. Among these positively chargeable charge control agents, the nigrosine compound is particularly preferred for a reason of achieving quicker charge rise characteristic. Two or more types of these positively chargeable charge control agents can be used in combination with each other.

Resin with a quaternary ammonium salt, a carboxylate salt, or a carboxyl group as a functional group may also be used as the positively chargeable charge control agent. More specifically, the following examples can be given: styrene-based resin with a quaternary ammonium salt, acrylic resin with a quaternary ammonium salt, styrene-acrylic resin with a quaternary ammonium salt, polyester resin with a quaternary ammonium salt, styrene-based resin with a carboxylate salt, acrylic resin with a carboxylate salt, styrene-acrylic resin with a carboxylate salt, polyester resin with a carboxylate salt, styrene-based resin with a carboxyl group, acrylic resin with a carboxyl group, styrene-acrylic resin with a carboxyl group, or polyester resin with a carboxyl group. The molecular weight of such resins is not particularly limited but may be an oligomer or a polymer.

For a specific example of the negatively chargeable charge control agent, an organometallic complex or a chelate compound can be given. For the organometallic complex or the chelate compound, it is preferable to use: a metal acetylacetonate complex such as aluminum acetylacetonate or iron (II) acetylacetonate, or a salicylic acid-based metal complex such as 3,5-di-tert-butylsalicylic acid chromium, or salicylic acid-based metal salt. The salicylic acid-based metal complex or the salicylic acid-based metal salt is more preferable. Two or more types of these negatively chargeable charge control agents can be used in combination with each other.

The amount of use of the positively or negatively chargeable charge control agent should preferably be 1.5 parts by mass or more and 15 parts by mass or less, with respect to 100 parts by mass of the total amount of toner, and more preferably be 2.0 parts by mass or more and 8.0 parts by mass or less. If the amount of use of the charge control agent is too small, it is difficult to stably charge the toner to a predetermined polarity. Thus, there is a case where the image density of the formed image is below a predetermined level or it becomes difficult to maintain the image density for a long time. In addition, in this case, it is difficult to uniformly disperse the charge control agent within the toner, thus making it more likely to cause fogging in the formed image or stain on the latent image bearing member by the toner. On the other hand, if the amount of use of the charge control agent is too large, it is likely to cause insufficient charge of the toner under high temperature and high humidity due to deterioration in environment resistance of the toner. In this case, problems such as image defect in the formed image or stain on the latent image bearing member are more likely to occur.

[Magnetic Powder]

The electrostatic latent image developing toner according to the present disclosure may include magnetic powder as desired. For a preferred example of the magnetic powder, the following can be given: iron such as ferrite or magnetite; ferromagnetic metal such as cobalt or nickel; an alloy including iron and/or ferromagnetic metal; a compound including iron and/or ferromagnetic metal; a ferromagnetic alloy treated by ferromagnetic treatment such as heat treatment; and chromium dioxide.

A particle diameter of the magnetic powder should preferably be 0.1 μm or more and 1.0 μm or less, and more preferably be 0.1 μm or more and 0.5 μm or less. In the case of using the magnetic powder having a particle diameter within the range as described above, it is easier to uniformly disperse the magnetic powder within the binder resin.

For the magnetic powder, to improve the dispersibility of the magnetic powder in the binder resin, it is possible to use a magnetic powder that is surface-treated with a surface preparation agent such as a titanium coupling agent or a silane coupling agent.

The amount of use of the magnetic powder, in the case of using the toner as a one component developer, should preferably be 35 parts by mass or more and 60 parts by mass or less, with respect to 100 parts by mass of the total amount of toner, and more preferably be 40 parts by mass or more and 60 parts by mass or less. If the amount of use of the magnetic powder is too large, there is a case where it is difficult to maintain the image density at a desired level for a long time or fixability of the toner onto the paper is extremely reduced. On the other hand, if the amount of use of the magnetic powder is too small, there is a case where the formed image is likely to have fogging or it becomes difficult to maintain the image density at a desired level for a long time. In addition, in the case of using the toner as a two component developer, the amount of the magnetic powder should preferably be 20% by mass or less with respect to 100 parts by mass of the total amount of the toner, and more preferably be 15% by mass or less.

[External Additive]

The electrostatic latent image developing toner according to the present disclosure may have a surface treated with an external additive, as desired. It should be noted that in the specification of the present disclosure, toner particles yet to be treated with an external additive are referred to as "toner base particles". The type of the external additive can be selected appropriately from external additives that have been used for toner since before. For specific examples of the preferred external additive, it is possible to give: silica, or metal oxide such as alumina, titanium oxide, magnesium oxide, zinc oxide, strontium titanate, and barium titanate. Two or more types of these external additives can be used in combination with each other. In addition, these external additives can be hydrophobized for use, using a hydrophobizing agent such as an aminosilane coupling agent or silicone oil. In the case of using a hydrophobized external additive, it becomes easier to suppress decrease in charge amount of the toner under high temperature and high humidity, and also it becomes easier to obtain the toner having excellent fluidity.

A particle diameter of the external additive should preferably be 0.01 μm or more and 1.0 μm or less.

The amount of use of the external additive should preferably be 0.1 parts by mass or more and 10 parts by mass or less, with respect to 100 parts by mass of toner particles before treatment with the external additive (toner base particles), and more preferably be 0.2 parts by mass or more and 5 parts by mass or less.

[Method for Manufacturing the Electrostatic Latent Image Developing Toner]

A method for manufacturing the electrostatic latent image developing toner according to the present disclosure is not particularly limited as long as the method allows mixing of the releasing agent with the binder resin and thereby allows manufacturing of the toner including an optional component as described above as necessary. Preferred methods include a pulverizing method and an aggregation method. In the pulverizing method, essential components such as a binder resin and a releasing agent, and an optional component such as a colorant, a charge control agent, or magnetic powder are mixed. A mixture obtained thereby is melted and kneaded by a melt-kneader such as a single-axis or biaxial extruder, and a product thus obtained from the melting and kneading is pulverized and classified, thereby obtaining toner particles (toner base particles). In the aggregation method, particulates of the components included in the toner, such as the binder resin, the releasing agent, and the colorant, are aggregated in an aqueous medium, thereby obtaining aggregated particles. Next, the aggregated particles are heated so as to coalesce components included in the aggregated particles, thereby obtaining toner particles (toner base particles). Of these methods, the pulverizing method is the more preferable. Generally, an average particle diameter of the toner particles (toner base particles) should preferably be 5 μm or more and 10 μm or less.

The surface of the toner base particles thus obtained may be treated with an external additive as necessary. The method for treating the toner base particles using an external additive is not particularly limited and can be selected appropriately from among known treatment methods using external additives. Specifically, conditions for external addition treatment are adjusted such that the particles of the external additives are not embedded in the toner base particles, and the treatment using the external additive is performed, using a mixer such as a Henschel mixer or a Nauta Mixer.

[Carrier]

The electrostatic latent image developing toner according to the present disclosure can also be mixed with a desired carrier for use as a two component developer. For preparing the two component developer, it is preferable to use a magnetic carrier.

In addition, for an example of a preferred carrier, a carrier having a carrier core coated with resin can be given. For specific examples of the carrier core, it is possible to give: particles of metal such as iron, oxidatively-treated iron, reduced iron, magnetite, copper, silicon steel, ferrite, nickel, or cobalt; particles of an alloy made from these materials and metal such as manganese, zinc, or aluminum; particles of an iron alloy such as a nickel-iron alloy or a cobalt-iron alloy; particles of ceramics such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; particles of a high-permittivity substance such as ammonium dihydrogen phosphate, potassium dihydrogen phosphate, or Rochelle salt; and a resin carrier formed by dispersing the above magnetic powder in resin.

For specific examples of the resin for coating the carrier core, it is possible to give: a (meth)acrylic polymer, a styrene-based polymer, a styrene-(meth)acrylic copolymer, an olefin-based polymer (polyethylene, chlorinated polyethylene, or polypropylene), polyvinyl chloride, polyvinyl acetate, polycarbonate, cellulose resin, polyester resin, unsaturated polyester resin, polyamide resin, polyurethane resin, epoxy resin, silicone resin, fluororesin (polytetrafluoroethylene, polychlorotrifluoroethylene, or polyvinylidene fluoride), phenol resin, xylene resin, diallyl phthalate resin, polyacetal resin, or amino resin. Two or more types of these resins can be used in combination with each other.

A particle diameter of the carrier is measured using an electron microscope. The particle diameter of the carrier should preferably be 20 μm or more and 120 μm or less, and more preferably be 25 μm or more and 80 μm or less.

In the case of using the toner according to the present disclosure as a two component developer, a toner content in the two component developer should preferably be 3% by mass or more and 20% by mass or less with respect to the mass of the two component developer, and more preferably be 5% by mass or more and 15% by mass or less. By setting the toner content in the two component developer within such a range, it becomes easier to maintain the image density of the formed image at an appropriate level as well as suppressing toner scatter from the developing device, thus suppressing toner stain on an inner part of the image forming apparatus or toner attachment to transfer paper.

[Thermomechanical Analysis (TMA)]

For the toner according to the present disclosure, the maximum thermal expansion coefficient difference ($Sw_{max}$−$Sr_{max}$) that is a difference between the maximum value ($Sw_{max}$) of the thermal expansion coefficient of the releasing agent and the maximum value ($Sr_{max}$) of the thermal expansion coefficient of the binder resin is 1 or more. It should be noted that the maximum expansion coefficient difference is a difference between the value of $Sw_{max}$ and the value of $Sr_{max}$, and is a dimensionless value. In addition, the thermal expansion coefficient of the releasing agent reaches the maximum at a temperature of 60° C. or more and 75° C. or less. It should be noted that the maximum value of the thermal expansion coefficient of the releasing agent and the maximum value of the thermal expansion coefficient of the binder resin are measured using a thermomechanical analyzer (TMA). The toner according to the present disclosure includes a combination of the binder resin and the releasing agent having such thermal characteristics, and therefore excels in preservation stability, low temperature fixability, and high temperature offset resistance.

If the maximum thermal expansion coefficient difference ($Sw_{max}$−$Sr_{max}$) is too small, at the time of fixing, the releasing agent is difficult to flow out from the toner melted by heating. Therefore, by using the toner of which the maximum thermal expansion coefficient difference ($Sw_{max}$−$Sr_{max}$) is too small, it is difficult to obtain sufficient mold releasability, between a heat roller and a toner image. Thus, such toner is poor in low temperature fixability and high temperature offset resistance.

It is possible to adjust the maximum thermal expansion coefficient difference ($Sw_{max}$−$Sr_{max}$) by adjusting the maximum value ($Sw_{max}$) of the thermal expansion coefficient of the releasing agent and the maximum value ($Sr_{max}$) of the thermal expansion coefficient of the binder resin. Then, it is possible to adjust the maximum value ($Sw_{max}$) of the thermal expansion coefficient of the releasing agent by adjusting the carbon number distribution of the releasing agent. For example, the maximum value ($Sw_{max}$) of the thermal expansion coefficient of the releasing agent tends to decrease by narrowing the carbon number distribution of the releasing agent, and tends to increase by broadening the carbon number distribution of the releasing agent. The maximum value ($Sw_{max}$) of the thermal expansion coefficient of the releasing agent is not particularly limited as long as the maximum thermal expansion coefficient difference ($Sw_{max}-Sr_{max}$) is 1 or more, but should preferably be 3.0% or more, and more preferably be 3.0% or more and 4.5% or less.

In addition, the maximum value of the thermal expansion coefficient of the binder resin ($Sr_{max}$) is adjustable by, for example, adjusting the molecular weight of the binder resin. The maximum value of the thermal expansion coefficient ($Sr_{max}$) of the binder resin tends to decrease by increasing the molecular weight of the binder resin, and tends to increase by decreasing the molecular weight of the binder resin.

The temperature at which the thermal expansion coefficient of the releasing agent reaches the maximum can be adjusted by adjusting the average carbon number of the releasing agent. For example, it is possible to decrease the temperature at which the thermal expansion coefficient of the releasing agent reaches the maximum by reducing the average carbon number of the releasing agent. In addition, it is possible to increase the temperature at which the thermal expansion coefficient of the releasing agent reaches the maximum by increasing the average carbon number of the releasing agent.

For measurement using the thermomechanical analyzer (TMA), for example, a thermomechanical analyzer ("TMA/SS6100" manufactured by SII Nano Technology) may be used.

The measurement to be performed on the releasing agent and the binder resin by the thermomechanical analyzer (TMA) may be performed on the releasing agent and the binder resin that are materials used for toner preparation, or may be performed on the releasing agent and the binder resin that are separated from the toner. Although the method for separating the releasing agent and the binder resin from the toner is not particularly limited, the following method can be given, for example.

<Method for Separating the Releasing Agent and the Binder Resin>

The toner is immersed in methyl ethyl ketone (MEK), and a sample obtained after allowing the toner to stand for 24 hours at 25° C. is filtered by glass filter (opening standard 11G-3). A filtrate thus obtained is allowed to stand for 12 hours, and a supernatant liquid is taken. The supernatant liquid thus taken is vacuum dried at 60° C., and the binder resin can be obtained as a residue remaining after drying. Next, the residue on the glass filter is immersed in toluene of 50° C., and is allowed to stand for 24 hours at 25° C., thereby obtaining a sample. A sample thus obtained is filtered by glass filter (opening standard 11G-3). After allowing a filtrate thus obtained to stand for 12 hours, a supernatant liquid is taken. The supernatant liquid thus taken is vacuum dried at 60° C., and the releasing agent can be obtained as a residue remaining after drying.

As described above, the electrostatic latent image developing toner according to the present disclosure has excellent preservation stability, low temperature fixability, and high temperature offset resistance. Thus, the electrostatic latent image developing toner according to the present disclosure is preferably used in various image forming apparatuses.

EXAMPLES

The following describes the present disclosure in further detail using examples. It should be noted that the present disclosure is not to be limited at all according to the examples.

In Examples and Comparative Examples, releasing agents A to F were used. Methods for manufacturing the releasing agents A to E are described in Preparation Example 1. For the releasing agent F, a commercially available carnauba wax ("Carnauba Wax No. 1 (natural ester wax)" manufactured by TOA KASEI CO., LTD.) was used. Table 1 shows, of ester included in the carnauba wax, the carbon number distribution of the acyl group and the carbon number distribution of the alkyl group derived from alcohol.

Preparation Example 1

Preparing Releasing Agents A to E

The releasing agents A to E, which were ester waxes, were prepared according to the following procedures, using a carboxylic acid component and an alcohol component that have a carbon number distribution as described in Table 1.

A four neck flask of a 1 liter capacity, having a thermometer, a nitrogen introduction tube, a stirrer ("Homogenizer (Ultra-Turrax T 50)" manufactured by Ika Works), and a cooling tube, was used as a reaction container. To the reaction container, 50 parts by mass of a carboxylic acid component of the type described in Table 2 and 50 parts by mass of an alcohol component of the type described in Table 2, were added. Next, under nitrogen gas stream, by causing a reaction under normal pressure at 220° C. and an agitating speed of 3000 rpm for 15 hours while distilling away by-product water, an esterification crude product was obtained. 20 parts by mass of ion-exchange water was added to 100 parts by mass of the esterification crude product thus obtained, which was stirred at an agitation speed of 3500 rpm at 70° C. for 30 minutes, and then was allowed to stand for 30 minutes, and an aqueous layer was separated and removed. Water washing was repeatedly performed until pH of the separated aqueous layer became neutral. The remaining ester layer was heated to 180° C. under a condition of reduced pressure of 1 kPa so as to remove volatile, thereby obtaining ester wax.

TABLE 1

| | | | Carbon number | | | | | | | | | | | | |
|---|---|---|---|---|---|---|---|---|---|---|---|---|---|---|---|
| | | | 12 | 14 | 16 | 18 | 20 | 22 | 24 | 26 | 28 | 30 | 32 | 34 | 36 |
| Synthetic ester wax | Carboxylic component | Behenic acid A (% by mass) | — | — | — | 1 | 10 | 87 | 2 | — | — | — | — | — | — |
| | | Behenic acid B (% by mass) | — | — | — | 6 | 14 | 80 | — | — | — | — | — | — | — |
| | | Palmitic acid (% by mass) | — | 1 | 95 | 4 | — | — | — | — | — | — | — | — | — |

TABLE 1-continued

| | | Carbon number | | | | | | | | | | | | |
|---|---|---|---|---|---|---|---|---|---|---|---|---|---|---|
| | | 12 | 14 | 16 | 18 | 20 | 22 | 24 | 26 | 28 | 30 | 32 | 34 | 36 |
| Alcohol component | Behenyl alcohol A (% by mass) | — | — | — | 2 | 6 | 85 | 7 | — | — | — | — | — | — |
| | Behenyl alcohol B (% by mass) | — | — | — | 8 | 16 | 70 | 6 | — | — | — | — | — | — |
| | Stearyl alcohol A (% by mass) | — | — | 2 | 96 | 2 | — | — | — | — | — | — | — | — |
| | Stearyl alcohol B (% by mass) | — | — | 16 | 80 | 4 | — | — | — | — | — | — | — | — |
| Carnauba wax | Acyl group (% by mass) | 3 | 6 | 13 | 12 | 28 | 13 | 18 | 4 | 3 | — | — | — | — |
| | Alkyl group derived from alcohol (% by mass) | — | — | — | — | — | 2 | 3 | 2 | 5 | 13 | 54 | 18 | 3 |

TABLE 2

| Releasing agent | Carboxylic component type | Alcohol component type |
|---|---|---|
| A | Behenic acid B | Stearyl alcohol A |
| B | Behenic acid A | Stearyl alcohol B |
| C | Palmitic acid | Behenyl alcohol B |
| D | Behenic acid A | Behenyl alcohol B |
| E | Behenic acid A | Behenyl alcohol A |

Examples 1 and 2, and Comparative Examples 1 to 4

48 parts by mass of polyester resin A and 39 parts by mass of polyester resin B as described below, as the binder resin, 8 parts by mass of the colorant ("Carbon Black (MA-100)" manufactured by Mitsubishi Chemical Corporation), 2 parts by mass of the charge control agent ("N-01" manufactured by ORIENT CHEMICAL INDUSTRIES, CO., Ltd.), and 3 parts by mass of the releasing agent of the types described in Table 2 were mixed using a Henschel mixer ("FM-10" manufactured by Mitsui Mining Company, Ltd.). The mixture thus obtained was melted and kneaded using a biaxial extruder ("TEM-26SS" manufactured by Toshiba Machine Co. Ltd.), thereby obtaining a product resulting from the melting and kneading. The product resulting from the melting and kneading, after being cooled, was coarsely pulverized down to an average particle diameter of approximately 2 mm, using a Rotoplex grinder (manufactured by TOA MACHINERY MFG. GO., LTD.). Next, using a turbo mill ("RS type" manufactured by TURBO KOGYO CO., Ltd.), the coarsely pulverized product was finely pulverized. The finely pulverized product was classified using an air classifier ("EJ-L-3 (LABO type)" manufactured by Nittetsu Mining Co., Ltd.), thereby obtaining toner base particles having a volume average particle diameter of 7.0 μm. The volume average particle diameter of the toner base particles thus obtained was measured using a particle size distribution measurement device ("Multisizer 3" manufactured by Beckman Coulter, Inc.).

Polyester resin A: Mass average molecular weight (Mw) 320000, Glass transition point (Tg) 66° C.

Polyester resin B: Mass average molecular weight (Mw) 80000, Glass transition point (Tg) 62° C.

To 100 parts by mass of the toner base particles thus obtained, 1.5 parts by mass of positively-chargeable silica particulates ("RA 200" manufactured by Nippon Aerosil Co., Ltd.) and 1.0 parts by mass of titanium oxide ("MT-500B" manufactured by TAYCA CORPORATION) were added. These were mixed at a rotation rate of 3500 rpm for 5 minutes using a Henschel mixer ("FM-10" manufactured by Mitsui Mining Company, Ltd.) for performing the external addition treatment, thereby obtaining the toner as described in each of Examples 1 and 2 and Comparative Examples 1 to 4.

[Thermomechanical Analysis (TMA)]

The binder resin and the releasing agent were separated from the toner in each of Examples 1 and 2 and Comparative Examples 1 to 4, according to the method below. Next, with the binder resin and the releasing agent that are obtained by the separation, the thermal expansion coefficient curve of the binder resin and the thermal expansion coefficient curve of the releasing agent were measured according to a TMA measurement method as described below. Next, the maximum thermal expansion coefficient ($Sr_{max}$) of the binder resin, the maximum thermal expansion coefficient ($Sw_{max}$) of the releasing agent, and the temperature at which the thermal expansion coefficient of the releasing agent reached the maximum were obtained from the obtained thermal expansion coefficient curves of the binder resin and the releasing agent. The maximum thermal expansion coefficient difference ($Sw_{max}-Sr_{max}$) was calculated from the maximum thermal expansion coefficient ($Sw_{max}$) of the releasing agent and the maximum thermal expansion coefficient ($Sr_{max}$) of the binder resin. Table 3 shows a result of the measurement, regarding the toner in each of Examples 1 and 2 and Comparative Examples 1 to 4, of the maximum thermal expansion coefficient ($Sr_{max}$) of the binder resin, the maximum thermal expansion coefficient ($Sw_{max}$) of the releasing agent, the temperature at which the thermal expansion coefficient of the releasing agent reaches the maximum, and the maximum thermal expansion coefficient difference ($Sw_{max}-Sr_{max}$). In addition, FIG. 1 shows the thermal expansion coefficient curves of the releasing agent and the binder resin that are included in the toner in Example 1. In addition, FIGS. 2 to 6 show the thermal expansion coefficient curves of the releasing agent and the binder resin that are included in the toner in each of Example 2 and Comparative Examples 1 to 4.

<Method for Separating the Releasing Agent and the Binder Resin>

10 g of toner was immersed in 200 ml of methyl ethyl ketone (MEK), which was allowed to stand at 25° C. for 24 hours, thereby obtaining a sample. Then, the sample thus obtained was filtered by glass filter (opening standard 11G-3). A filtrate was allowed to stand for 12 hours, and a supernatant liquid was taken. The supernatant liquid thus taken was vacuum dried at 60° C., thereby obtaining the binder resin as a residue remaining after drying. Next, the residue on the glass filter was immersed in 300 ml of toluene of 50° C., which was allowed to stand at 30° C. for 24 hours, and a sample was obtained. The sample thus obtained was filtered by glass filter (opening standard 11 G-3). After allowing the filtrate to stand for 12 hours, the supernatant liquid was taken. The supernatant liquid was vacuum dried at 60° C., thereby obtaining the releasing agent as a residue after drying.

<TMA Measurement Method>

For the thermomechanical (TMA) measurement, the measurement was performed using a thermomechanical analyzer ("TMA/SS6100" manufactured by SII Nano Technology). The linear expansion coefficient was obtained using a measurement method according to the "Testing method for linear thermal expansion coefficient of plastics by thermomechanical analysis" by JIS K 7197. The measurement was performed by varying the measurement temperature from 25° C. to 160° C. at a rate of temperature increase of 2.0° C./minute. 0.3 g of the sample was shaped to a diameter of 1 cm and a thickness of 2 mm. The measurement was performed by setting device conditions to: probe diameter of 1.0 mm; probe diameter of 2.0 mm, prove load of 50 mN, and nitrogen flow at 80 ml/minute. It should be noted that the thermal expansion coefficient and the linear expansion coefficient have the same meaning.

FIG. 1 shows the thermal expansion coefficient curve of each of the releasing agent and the binder resin that are included in the toner in Example 1. From the thermal expansion coefficient curve shown in FIG. 1, the maximum thermal expansion coefficient ($Sr_{max}$) of the binder resin and the maximum thermal expansion coefficient ($Sw_{max}$) of the releasing agent were obtained as described in Table 3. In addition, from the thermal expansion coefficient curve of the releasing agent, the temperature at which the thermal expansion coefficient reached the maximum was obtained as described in Table 3.

FIGS. 2 to 6 show the thermal expansion coefficient curve of each of the releasing agent and the binder resin that are included in the toner in each of Example 2 and Comparative Examples 1 to 4. From each of the thermal expansion coefficient curves shown in FIGS. 2 to 6, the maximum thermal expansion coefficient ($Sr_{max}$) of the binder resin and the maximum thermal expansion coefficient ($Sw_{max}$) of the releasing agent were obtained as described in Table 3. In addition, from the thermal expansion coefficient curve of the releasing agent, the temperature at which the thermal expansion coefficient reached the maximum was obtained as described in Table 3. It should be noted that the thermal expansion coefficient curve of the binder resin included in the toner in each of Example 2 and Comparative Examples 1 to 4 was the same as the thermal expansion coefficient curve of the binder resin included in the toner in Example 1.

<<Evaluation 1>>

Regarding the toner in each of Examples 1 and 2 and Comparative Examples 1 to 4, the heat-resisting preservation stability and the dispersibility of the releasing agent were evaluated according to the method below. Table 3 shows a result of the evaluation of the heat-resisting preservation stability of the toner and the dispersibility of the releasing agent in the toner in each of Examples 1 and 2 and Comparative Examples 1 to 4.

<Evaluation Method for Heat-Resisting Preservation Stability>

10 g of toner was weighed in a sample bottle made of glass, and the sample bottle containing the toner, which was not sealed with a stopper, was allowed to stand for 100 hours in a constant temperature reservoir ("CONVECTION OVEN" manufactured by SANYO Electric Co., Ltd.) of 50° C. Next, a sieve of 26 mesh having a known mass was attached to a powder tester ("TYPE PT-E 84810" manufactured by Hosokawa Micron Corporation), and the toner after standing at high temperature was placed on the sieve and weighed before sieving. Next, the toner was sieved for 20 seconds on a condition of rheostat 2.5. Next, the mass of the residual toner remaining on the sieve was measured. The heat-resisting preservation stability was evaluated according to a reference as below.

Good: Residual toner on the mesh was 0.2 g or less.

Poor: Residual toner on the mesh was over 0.2 g.

<Evaluation Method for Dispersibility of the Releasing Agent>

5 g of toner was compressed at a pressure of 20 MPa, so as to prepare a pellet of a cylindrical shape having a diameter of 4 cm and a thickness of 3 mm. From the pellet thus obtained, a thin piece having a thickness of 100 μm was cut out, using a microtone ("REM 710 RETORATOME" manufactured by YAMATO KOHKI INDUSTRIAL CO., LTD.), and this was used as an observation sample. The observation sample thus obtained was observed at 3000-fold magnification, using a transmission electron microscope ("HF-3300" manufactured by Hitachi High-Technologies), so as to evaluate the dispersibility of the releasing agent in the toner. The dispersibility of the releasing agent was evaluated according to a reference as below.

Good: Lumps of the releasing agent were hardly seen.

Average: Only a few lumps of the releasing agent were seen.

Poor: A number of lumps of the releasing agent were seen.

<<Evaluation 2>>

The low temperature fixability and the high temperature offset resistance were evaluated using the toner in each of Examples 1 and 2 and Comparative Examples 1 to 4, according to the method below. As a fixability tester, a fixing device was used that was converted from a fixing device of a color printer ("FS-C5016" manufactured by Kyocera Document Solutions Ltd.) by installing an external drive device and a fixing temperature controller thereto. As an evaluation device, a device converted by removing the fixing device from the color printer ("FS-C5016" manufactured by Kyocera Document Solutions Ltd.) was used. For a recording medium, an evaluation sheet ("Color Copy 90" manufactured by Neusiedler) was used. It should be noted that the evaluation was performed using the two component developer prepared according to the method below. Table 3 shows the evaluation results for the toner in each of Examples 1 and 2 and Comparative Examples 1 to 4.

Preparation Example 2

Preparation of a Two Component Developer 10 parts by mass of toner was mixed with 100 parts by mass of the carrier used for the color printer ("FS-C5016" manufactured by Kyocera Document Solutions Ltd.), and the mixture was encapsulated in a plastic bottle and the plastic bottle was rotated for 30 minutes at a rotation rate of 100 rpm by a ball mill (manufactured by Kyocera Document Solutions Ltd.) so as to uniformly stir and mix the carrier and the toner in the plastic bottle, thereby obtaining a two component developer.

<Evaluation Method for Low Temperature Fixability>

A developing device for black in the color printer ("FS-C5016" manufactured by Kyocera Document Solutions Ltd.) was filled with the two component developer that was prepared using the toner in each of Examples and Comparative Examples, and a toner container for black was filled with the toner in each of Examples and Comparative Examples. Using the evaluation device, a toner image of 2 cm×3 cm (patch sample) was output onto the recording medium as an unfixed image such that the toner mount amount was 1.8 mg/cm$^2$. Next, using the fixability tester, the unfixed image of the patch sample was fixed at a linear speed of 280 mm/second. The image after fixing was folded in half such that an image portion was present inside, and a crease was frictioned back and forth 5 times with a weight of 1 kg having a bottom covered with a cloth. After the friction, the paper was unfolded, to determine that the result was passing if the peeling of the toner was 1 mm or less and that the result was failed if the peeling of the toner was over 1 mm. The fixing temperature was evaluated by increasing the temperature from 140° C. in increments of 5° C., and the low temperature fixability was evaluated according to an evaluation reference below, assuming a lowest fixing temperature at which the peeling of the toner was determined to be pass as the lowest fixing temperature.

Good: The lowest fixing temperature was 160° C. or less.

Poor: The lowest fixing temperature was over 160° C.

<Evaluation Method for High Temperature Offset Resistance>

The same developing device and toner container that were used in the measurement according to the evaluation method for low temperature fixability were used. Using the evaluation device, a toner image of 2 cm×3 cm (patch sample) was output onto the recording medium as an unfixed image such that the toner mount amount was 1.8 mg/cm$^2$. Next, using the fixability tester, the unfixed image of the patch sample was fixed at a linear speed of 280 mm/second. Using the fixed image, whether or not a high temperature offset occurred was visually checked. The evaluation was performed by increasing the fixing temperature from 140° C. in increments of 5° C., and the high temperature offset resistance was evaluated according to an evaluation reference below, assuming a highest temperature at which the offset did not occur as a high temperature offset non-occurrence temperature.

Good: The high temperature offset non-occurrence temperature was 200° C. or more.

Poor: The high temperature offset non-occurrence temperature was below 200° C.

TABLE 3

| | Examples | | Comparative Examples | | | |
|---|---|---|---|---|---|---|
| | 1 | 2 | 1 | 2 | 3 | 4 |
| Type of releasing agent | A | B | C | D | E | F |
| Maximum thermal expansion coefficient of binder resin ($Sr_{max}$) [%] | 0.60 | 0.60 | 0.60 | 0.60 | 0.60 | 0.60 |
| Maximum thermal expansion coefficient of releasing agent ($Sw_{max}$) [%] | 3.00 | 4.20 | 2.30 | 1.58 | 2.66 | 1.10 |
| Thermal expansion peak temperature of releasing agent [° C.] | 63 | 70 | 57 | 71 | 80 | 75 |
| Maximum thermal expansion coefficient difference ($Sw_{max} - Sr_{max}$) | 2.40 | 3.60 | 1.70 | 0.98 | 2.06 | 0.50 |
| Evaluation 1 | | | | | | |
| Dispersibility of releasing agent | Good | Good | Good | Good | Good | Average |
| Heat-resisting preservation stability | | | | | | |
| Residual toner on mesh [g] | 0.20 | 0.18 | 0.30 | 0.17 | 0.13 | 0.15 |
| Evaluation | Good | Good | Poor | Good | Good | Good |
| Evaluation 2 | | | | | | |
| Low temperature fixability | | | | | | |
| Lowest fixing temperature [° C.] | 155 | 160 | 155 | 170 | 175 | 165 |
| Evaluation | Good | Good | Good | Poor | Poor | Poor |
| High temperature offset resistance | | | | | | |
| High temperature offset non-occurrence temperature [° C.] | 200 | 210 | 190 | 190 | 210 | 195 |
| Evaluation | Good | Good | Poor | Poor | Good | Poor |

For the electrostatic latent image developing toner in each of Examples 1 and 2, the maximum thermal expansion coefficient difference ($Sw_{max}$–$Sr_{max}$) that is a difference between the maximum value of the thermal expansion coefficient ($Sw_{max}$) of the releasing agent and the maximum value of the thermal expansion coefficient ($Sr_{max}$) of the binder resin is 1 or more, and the temperature at which the thermal expansion coefficient in the thermal expansion coefficient curve of the releasing agent reaches the maximum is 60° C. or more and 75° C. or less. It is shown that such electrostatic latent image developing toner has excellent preservation stability, low temperature fixability, and high temperature offset resistance.

For the electrostatic latent image developing toner in Comparative Example 1, the temperature at which the thermal expansion coefficient of the releasing agent reaches the maximum was too low. In this case, it is shown that it is difficult to obtain the toner having excellent preservation stability and high temperature offset resistance.

For the electrostatic latent image developing toner in each of Comparative Examples 2 and 4, the thermal expansion coefficient difference ($Sw_{max}$–$Sr_{max}$) was too small. In this case, it is shown that it is difficult to obtain the toner having excellent low temperature fixability and high temperature offset resistance. In addition, it is shown that for the toner in Comparative Example 4, the wax is difficult to sufficiently disperse within the toner.

According to the electrostatic latent image developing toner in Comparative Example 3, it is shown that: if the temperature at which the thermal expansion coefficient of the releasing agent reaches the maximum is too high, it is difficult to obtain the toner having excellent low temperature fixability.

What is claimed is:

1. An electrostatic latent image developing toner comprising at least a binder resin and a releasing agent, wherein the releasing agent includes an ester wax from carboxylic acid component A and alcohol component B or an ester wax from carboxylic acid component B and alcohol component A, the carboxylic acid component A includes a portion having carbon number 18 of a mass fraction 0.01, a portion having carbon number 20 of a mass fraction 0.10, a portion having carbon number 22 of a mass fraction 0.87, and a portion having carbon number 24 of a mass fraction 0.02, the carboxylic acid component B includes a portion having carbon number 18 of a mass fraction 0.06, a portion having carbon number 20 of a mass fraction 0.14, and a portion having carbon number 22 of a mass fraction 0.80, the alcohol component A includes a portion having carbon number 16 of a mass fraction 0.02, a portion having carbon number 18 of a mass fraction 0.96, and a portion having carbon number 20 of a mass fraction 0.02, the alcohol component B includes a portion having carbon number 16 of a mass fraction 0.16, a portion having carbon number 18 of a mass fraction 0.80, and a portion having carbon number 20 of a mass fraction 0.04, a maximum thermal expansion coefficient difference ($Sw_{max}-Sr_{max}$) is 1 or more, the maximum thermal expansion coefficient being a difference between a maximum value ($Sw_{max}$) of a thermal expansion coefficient of the releasing agent and a maximum value ($Sr_{max}$) of a thermal expansion coefficient of the binder resin that are measured using thermomechanical analysis (TMA), a temperature at which the thermal expansion coefficient of the releasing agent reaches a maximum is 60° C. or more and 75° C. or less, the releasing agent has an average carbon number of 39 or more and 41 or less, and an amount of the releasing agent is 1 part by mass or more and 5 parts by mass or less, with respect to 100 parts by mass of the binder resin.

2. An electrostatic latent image developing toner according to claim 1, wherein the releasing agent is a synthetic ester wax.

3. An electrostatic latent image developing toner according to claim 1, wherein the maximum value ($Sw_{max}$) of the thermal expansion coefficient of the releasing agent is 3.0% or more.

4. An electrostatic latent image developing toner according to claim 1, wherein the electrostatic latent image developing toner is pulverized toner.

* * * * *